United States Patent [19]

Beeson

[11] 4,234,319

[45] Nov. 18, 1980

[54] PROCESS FOR CHANGING CAKING COALS TO NONCAKING COALS

[75] Inventor: Justin L. Beeson, Woodridge, Ill.

[73] Assignee: The United States of America as represented by the United States Department of Energy, Washington, D.C.

[21] Appl. No.: 33,076

[22] Filed: Apr. 25, 1979

[51] Int. Cl.[3] ..... C10L 9/02; C10L 9/06

[52] U.S. Cl. ..... 44/1 R; 44/1 SR

[58] Field of Search ..... 44/1 R, 1 SR, 6

[56] References Cited

U.S. PATENT DOCUMENTS

| | | | |
|---|---|---|---|
| 3,357,896 | 12/1967 | Gasior et al. | 44/1 R |
| 4,092,125 | 5/1978 | Stambaugh et al. | 44/1 SR |
| 4,095,955 | 6/1978 | Stambaugh et al. | 44/1 SR |
| 4,099,929 | 7/1978 | Tippmer et al. | 44/1 SR |

OTHER PUBLICATIONS

Feldman et al., A Novel Approach to Coal Gasification Using Chemically Incorporated CaO (Phase II), Nov. 11, 1977, Columbus, Ohio, pp. 1-30.

Coal Pretreatment in Fluidized Bed, Kavlick et al., ACS 152nd Meeting N. Y., N. Y. Sep. 1966 pp. 9-17.

Feldman et al., A Novel Approach to Coal Gasification Using Chemically Incorporated Catalysts, Batelle Columbus Labs. Aug. Monthly Report, Sep. 15, 1978.

*Primary Examiner*—Carl F. Dees

*Attorney, Agent, or Firm*—James E. Denny; Richard G. Besha; Hugh W. Glenn

[57] ABSTRACT

Caking coals are treated in a slurry including alkaline earth metal hydroxides at moderate pressures and temperatures in air to form noncaking carbonaceous material. Hydroxides such as calcium hydroxide, magnesium hydroxide or barium hydroxide are contemplated for slurrying with the coal to interact with the agglomerating constituents. The slurry is subsequently dewatered and dried in air at atmospheric pressure to produce a nonagglomerating carbonaceous material that can be conveniently handled in various coal conversion and combustion processes.

3 Claims, No Drawings

PROCESS FOR CHANGING CAKING COALS TO NONCAKING COALS

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention relates to a method for the benefication of coal prior to its use in combustion, liquefaction or gasification processes. Much of the bituminous and lignite coal in this country tends to agglomerate and cake when heated to high temperatures. The method of the present invention is an uncomplicated and improved procedure for converting such coal to a noncaking material.

In gasification, liquefaction, combustion and hydropyrolysis processes for converting coal and other carbonaceous materials to more useful forms, elevated temperatures are used. These temperatures are often at and above those at which the carbonaceous material becomes sticky and begins to cake or agglomerate. A hydropyrolysis process that employes high temperatures and high flow rates through small reactor passageways is disclosed in the assignee's copending patent applications U.S. DOE Docket No. S-50,424 entitled "Reactor and Method for Hydrocracking Carbonaceous Material" to Duncan et al., Ser. No. 15,257 filed Feb. 26, 1979 and U.S. DOE Docket No. S-50,975 entitled "Process for Hydrocracking Carbonaceous Material to Provide Fuels or Chemical Feed Stock" to Duncan, Ser. No. 15,258 filed Feb. 26, 1979. In processes and hydropyrolysis reactors like those described in these patent applications, the coal is heated to a temperature above 1200° F. while entrained within a high velocity gas stream. The agglomeration of coal can soon plug the tubular flow passageways leading to and in such reactors.

Although the above-mentioned hydropyrolysis processes are quite susceptible to interruption through plugging with caking coal, the present invention may have application in various other coal uses. For instance, the transport of coal by mechanical conveyors or fluidization is impeded by agglomeration. The feed and removal of coal from both fixed and fluidized-bed gasifiers, liquefiers and combustors are greatly facilitated if the problem of agglomeration can be minimized or eliminated.

Prior processes for decaking coal have required the use of extreme temperatures and pressures to avoid extended periods of processing time. Temperatures of 500° F. or above and pressures of 300–1000 psi have been used. Alternatively, comparative Example I of the present application shows that heating to moderate temperatures of about 300° F. for an extended period of about 5 hours or more can render coal noncaking.

PRIOR ART STATEMENT

The following publications relate to the technical field of the subject invention but do not disclose or make obvious the invention as claimed.

Feldman et al., "A Novel Approach to Coal Gasification Using Chemically Incorporated CaO (Phase II)", Summary Report to ERDA, BMI-1986, November 1977, under Contract W-7405-Eng-92 (Task 79). This publication discloses a process in which coal is slurried with calcium oxide in water and processed at elevated temperatures of about 500° F. or above and high pressures of about 1000 psig, e.g. see page 25. At page 16, this report indicates that these elevated temperatures and pressures are necessary to produce noncaking coal.

Gasior et al., "Decaking of Coal in Free Fall", American Chemical Society 152nd Meeting, New York, N.Y. September 1966. This paper describes caking coals processed in a free fall reactor filled with steam and oxygen at pressures of 250 to 330 psig and temperatures of about 600°–800° F. Table II on page 6 indicates considerable loss of volatile matter in the process.

Kavlick and Lee, "Coal Pretreatment in Fluidized Bed", American Chemical Society 152nd Meeting, New York, N.Y., September 1966. The paper describes a process in which caking coals were heated in a fluidized bed with air and nitrogen at atmospheric pressure and 700° F. At page 12 it is indicated that volatile matter must be reduced by 24 to 26% as a minimum.

SUMMARY OF THE INVENTION

In view of the above, it is an object of the present invention to provide a process for converting caking to noncaking coal at atmospheric pressure and moderate temperatures.

It is a further object to provide a process for rendering coals noncaking in which the loss of volatile matter is minimized.

It is a further object to provide a coal decaking process that can be carried out with moderately elevated temperatures within a few hours processing time.

In accordance with the present invention, a method is presented for changing caking coals to noncaking material by treating them with a water slurry of alkaline earth metal hydroxide. The method involves contacting the particles of coal with a slurry of alkaline earth metal hydroxide followed by removing water from the slurry mixture in air at about atmospheric pressure and temperatures below 350° F. to form a dry noncaking carbonaceous material for use as fuel or as feed stock for conversion processes.

In more specific aspects of the invention, the slurry including coal particles is dewatered and dried in air at about atmospheric pressure and moderate temperatures of about the slurry boiling point. For particularly difficult coals, the dry material can be maintained at an elevated temperature of about 300° F. in air to ensure a free-flowing character. Alkaline earth metal hydroxides of calcium, magnesium and barium are contemplated for use but, due to its availability and effectiveness, calcium hydroxide is advantageously selected, either alone or in mixture with another alkaline earth metal hydroxide, e.g. as in calcined dolomite. Materials such as bentonite clay and oxides of iron also can be employed in mixture.

Other specific aspects of the invention involve blending a dry alkaline earth metal oxide with the powdered agglomerating material to form a dry mixture and slurrying this mixture with water to provide the necessary contact. The slurried mixtures formed by the various techniques can be heated to temperatures near or slightly below the boiling point at atmospheric pressure in air for about 1 hour, dewatered, dried in air and heated to about 300° F. for a period of about 1–2 hours to ensure effective reduction of the agglomerating tendency.

DETAILED DESCRIPTION OF THE PREFERRED EMBODIMENT

In one manner of performing the present invention, coal is pulverized to small size particles, for instance of about 1/16 inch or smaller. The pulverized coal is mixed with an alkaline earth metal hydroxide or oxide such as those of calcium, magnesium, barium or various materials such as calcined dolomite or bentonite clay that include oxide forms of these metals. The alkaline earth metals can be in the oxide or hydroxide form and for purposes of this application the term "alkaline earth metal hydroxide" or reference to a particular alkaline earth metal hydroxide is intended also to contemplating the corresponding oxide. In most instances, the subsequent steps of slurrying alkaline earth metal oxides with water change at least a portion of these materials to the hydroxide form and, on drying or calcining, the oxide form may again return.

The alkaline earth metal hydroxide is included in amounts of about 1 to 10% by weight. Somewhat higher amounts of as much as 15% by weight can be employed for particularly difficult caking materials. Larger quantities of materials exceeding 15% by weight can be costly and may cause excessive oxygen uptake into the coal that may have deleterious effects on subsequent conversion processes.

Sufficient water is added to form a slurry of the solid materials. Excess water is to be avoided as it would dilute the alkaline earth metal hydroxide and require removal in the subsequent steps. It will be recognized that the water may be added to or provided with the alkaline earth metal hydroxide or the particulate coal individually prior to intermixing to form the slurry mixture.

The slurry mixture is heated to an elevated temperature to hasten the interaction of the alkaline earth metal hydroxide with the coal. A temperature at or slightly below the boiling point, e.g. about 212° F., at atmospheric pressure can be maintained for about 1 hour to assure this interaction. As an alternative, the coal-slurry contact can be maintained for an extended period, e.g. overnight or about 10–30 hours at ambient temperature.

Most of the water can be removed from the slurry mixture by a suitable operation such as filtration or centrifugation. The resulting cake is dried in air at about atmospheric pressure by heating to the required evaporation temperature, e.g. about the slurry boiling temperature. All of the water in the slurry may be removed by evaporation at the atmospheric boiling temperature but this procedure may be more costly and time-consuming than that of employing a preliminary mechanical dewatering step such as filtering or centrifuging. One other contemplated alternative is to permit the dewatered slurry cake to dry over an extended period of time at ambient temperatures in air at about atmospheric pressure. In such procedures, exposure over large areas to solar heating can accelerate the drying process.

To remove any dampness and to permit further interaction with the alkaline earth metal hydroxide and with air, the residual material can be heated in air to a temperature above the atmospheric boiling point, but no more than 350° F., for a period of about 1–2 hours. The material as thus formed has been found to be nonagglomerating, free flowing and ready for convenient handling in various coal combustion and conversion processes.

Some of the important aspects of the invention include contacting the coal with the alkaline earth metal hydroxide in aqueous slurry at about atmospheric pressure and temperatures at or below the slurry boiling point followed by drying the dewatered slurry in air at ambient pressure and temperatures below 350° F. The air contact permits further oxidation of outer layers of the material to enhance the noncaking characteristics of the coal. High temperatures and pressures not only are not needed but are to be avoided as temperatures in excess of 350°–400° F. may result in pyrolysis, loss of volatiles and ignition of the coal in contact with the surrounding air.

The following examples are presented to more specifically illustrate the present invention. Data involving Examples I–VI are summarized below in Table I. The Illinois No. 6 coal used in these examples had a free swelling index of about 4½ and formed hard caked masses on heating to above 1000° F. The initial sticking or caking began at about 900° F.

TABLE I

Proximate and Ultimate Analyses of Raw and Treated Coals

| | Raw Coal | Examples 1 | 2 | 3 |
|---|---|---|---|---|
| | (Proximate Analysis, Dry Ash-Free Basis) | | | |
| Volatile matter | 44.49 | 40.16 | 42.41 | 49.54 |
| Fixed carbon | 55.51 | 59.84 | 57.59 | 50.46 |
| | 100.00 | 100.00 | 100.00 | 100.00 |
| | (Ultimate Analysis, Dry Basis) | | | |
| Carbon | 68.80 | 65.80 | 65.90 | 59.10 |
| Hydrogen | 5.03 | 4.25 | 4.40 | 4.22 |
| Sulfur | 4.16 | 4.46 | 4.37 | 4.58 |
| Nitrogen | 1.16 | 1.12 | 1.18 | 1.06 |
| Oxygen | 10.09 | 13.42 | 11.97 | 10.43 |
| Ash | 10.76 | 10.95 | 12.18 | 20.61 |
| | 100.00 | 100.00 | 100.00 | 100.00 |
| | (Ultimate Analysis, Dry Ash-Free Basis) | | | |
| Carbon | 77.10 | 73.89 | 75.04 | 74.44 |
| Hydrogen | 5.63 | 4.77 | 5.01 | 5.32 |
| Sulfur | 4.66 | 5.01 | 4.98 | 5.77 |
| Nitrogen | 1.30 | 1.26 | 1.34 | 1.34 |
| Oxygen | 11.31 | 15.07 | 13.63 | 13.13 |
| | 100.00 | 100.00 | 100.00 | 100.00 |

| | Raw Coal | Examples 4 | 5 | 6 |
|---|---|---|---|---|
| | (Proximate Analysis, Dry Ash-Free Basis) | | | |
| Volatile matter | 44.49 | 46.64 | 44.02 | 40.86 |
| Fixed carbon | 55.51 | 53.36 | 55.98 | 59.14 |
| | 100.00 | 100.00 | 100.00 | 100.00 |
| | (Ultimate Analysis, Dry Basis) | | | |
| Carbon | 68.80 | 60.20 | 59.50 | 59.50 |
| Hydrogen | 5.03 | 4.28 | 4.22 | 3.97 |
| Sulfur | 4.16 | 3.87 | 4.44 | 4.26 |
| Nitrogen | 1.16 | 1.12 | 1.08 | 1.04 |
| Oxygen | 10.09 | 14.68 | 9.15 | 10.85 |
| Ash | 10.76 | 15.85 | 21.61 | 20.38 |
| | 100.00 | 100.00 | 100.00 | 100.00 |
| | (Ultimate Analysis, Dry Ash-Free Basis) | | | |
| Carbon | 77.10 | 71.54 | 75.91 | 74.72 |
| Hydrogen | 5.63 | 5.09 | 5.38 | 4.99 |
| Sulfur | 4.66 | 4.60 | 5.66 | 5.35 |
| Nitrogen | 1.30 | 1.33 | 1.38 | 1.31 |
| Oxygen | 11.31 | 17.44 | 11.67 | 13.63 |
| | 100.00 | 100.00 | 100.00 | 100.00 |

EXAMPLE I

Comparative Example

A sample of raw Illinois No. 6 coal was ground to −14 mesh U.S. Standard, and heated in air at atmospheric pressure and 300° F. for 5 hours. Samples were taken periodically and tested for caking by heating to approximately 1500° F. in a metal tube open at one end so that the test was essentially in the absence of air. At the end of 5 hours, the caking property of the coal had been completely destroyed, and the residue from the final test was a dry free-flowing powder. Samples taken prior to 5 hours agglomerated when tested. As can be seen from Table I, less volatile matter remained in the treated coal than in the other tabulated examples and the oxygen content increase in this example was relatively high.

EXAMPLE II

A sample of untreated Illinois No. 6 coal was ground to −14 mesh U.S. Standard and mixed with dry calcium hydroxide to obtain a mixture that was about 1.5% by weight calcium oxide. Water was then added to form a slurry which was heated at atmospheric pressure and 212° F. for 1 hour. The slurry was then dewatered and dried in air at room temperature. The dried material was further heated in air for about 1 hour at 300° F. and atmospheric pressure. Upon cooling, the coal thus treated was tested as in Example I and the residue from the test found to be a dry free-flowing material, showing that the caking tendency had been destroyed in a much shorter time than by air treatment alone. The volatile matter content of the treated coal was 42.41% by weight, only slightly less than the volatile matter content of the untreated coal, and the oxygen content of the treated coal was 13.63% by weight, somewhat greater than that of the untreated coal.

EXAMPLE III

About 6 pounds of raw coal were crushed to −60 mesh U.S. Standard and mixed with dry calcium hydroxide to obtain a mixture which was 7.5% by weight calcium oxide. This was slurried with water and dried by heating at atmospheric pressure, allowing the slurry to boil to dryness. A sample of the dried slurry was tested as before and found to be noncaking.

A further test was made by using the coal in a hydropyrolysis process similar to that described in the above-cited patent applications to Duncan and Duncan et al. Several hundred grams of the treated coal was processed in an entrained flow of hydrogen through a 0.12 inch I.D. tubular reactor operating at about 2000 psig and about 1475° F. The treated coal processed easily with no operating difficulties due to plugging or sticking, showing the treated coal to be noncaking. The oxygen content of the treated coal was 13.13% by weight and the volatile matter content was 49.54% by weight, somewhat higher than that of the untreated coal.

EXAMPLE IV

About 6 pounds of raw coal were crushed to −60 mesh U.S. Standard and mixed with dry calcium oxide to obtain a mixture which was 7.5% by weight calcium oxide. The mixture of coal and calcium hydroxide was slurried with water and dried by gently boiling to dryness, leaving the vessel containing the slurry in contact with its heat source overnight. A sample of the dried material was tested as in Example I and found to be noncaking. The treated coal was tested further by processing several hundred grams in the same small diameter, entrained-flow reactor as was used in Example III. The treated coal was processed in hydrogen, with the reactor operating at about 2000 psig and about 1475° F., for approximately 1 hour. The treated coal processed easily with no processing difficulties due to plugging or sticking. The oxygen content of the treated coal was much greater than in Example III, showing that prolonging the drying step can increase the oxygen content of the treated coal markedly.

EXAMPLE V

About 6 pounds of raw coal sized to −60 mesh U.S. Standard were mixed with iron oxide and calcium oxide to obtain a mixture which was 8.0% by weight iron oxide and 1.5% by weight calcium oxide. This was slurried with water and dried by heating. The dried slurry was then heated for about 1 hour at about 300° F. at atmospheric pressure to complete the treatment. A sample of the treated coal was tested as before and found to be noncaking. The treated coal was then tested further by processing several hundred grams in the small diameter pyrolysis reactor in entrained flow as described in Example III. The treated coal was processed in hydrogen, with the reactor operating at about 2000 psig and 1475° F. The oxygen content and volatile matter content of the treated coal were essentially the same as that of the untreated coal, showing that the loss of caking properties is not due to oxygen uptake alone.

EXAMPLE VI

About 6 pounds of raw coal crushed to −60 mesh U.S. Standard were mixed with dry bentonite clay and calcium hydroxide to obtain a mixture which was 8.0% by weight bentonite clay and 1.5% by weight calcium oxide. The mixture was then slurried with water and the slurry dried by boiling off the water. The dried slurry was further treated by heating in air for 2 hours at about 300° F. at atmospheric pressure. A sample of the treated coal was tested as in Example I and found to be noncaking, with the residue from the test being a dry free-flowing powder.

The treated coal then was tested further by processing several hundred grams in the small diameter, entrained-flow reactor as described in Example III. The coal was processed without difficulty due to plugging or sticking.

EXAMPLE VII 50 grams of Illinois No. 6 coal in each of two samples were mixed with 5 grams each respectively of $Ba(OH)_2$ and $Mg(OH)_2$. A third sample was used as a control without treatment. The two sample mixtures were slurried with water, allowed to stand overnight, dewatered by filtering and dried in air at room temperature for 24 hours. On testing as in Example I, the untreated coal was found to be strongly caking, the sample with $Mg(OH)_2$ noncaking and the sample with $Ba(OH)_2$ to be only weakly caking. This example shows the effectiveness of alkaline earth metal hydroxides other than calcium hydroxide and that elevated temperatures can be avoided if sufficient processing time is available.

EXAMPLE VIII

In a procedure similar to that of Example VII, about 10 weight percent $Ca(OH)_2$ in coal slurried in water was allowed to stand for about 24 hours. The slurry was dewatered by filtration and allowed to dry in air at room temperature, about 20°-25° C., over the weekend, i.e. about 72 hours. The resulting dry coal was found to be noncaking by the test procedure described in Example I.

It is therefore seen from the above that the present invention provides a process for converting caking to noncaking coal under atmospheric pressure and moderate temperatures. The method is a considerable improvement over those prior art processes which incorporate high pressures of up to 1000 psi and temperatures approaching 500° F. and above. Only small amounts of alkaline earth metal hydroxides such as calcium hydroxide are necessary and these materials included within the coal product may serve to reduce sulfur emissions in subsequent use and processing of the carbonaceous material.

It will also be clear that the present invention has been presented in terms of specific embodiments and that various changes can be made to the materials and process steps by one skilled in the art within the scope of the following claims.

The embodiments of the invention in which an exclusive property or privilege is claimed are defined as follows:

1. A method of rendering caking coals noncaking by treating with a water slurry of an alkaline earth metal hydroxide, consisting of:

forming an aqueous slurry mixture of coal and alkaline earth metal hydroxide at about 1 atmosphere pressure in air with the alkaline earth metal hydroxide being about 1-10 weight percent of the amount of coal included therein;

maintaining said slurry mixture in contact with air at about 1 atmosphere pressure and at a temperature near to its boiling point for about 1 hour;

removing the water from said slurry mixture by mechanical dewatering followed by heating to dryness in contact with air at about 1 atmosphere pressure and at about the slurry boiling temperature whereby slurry solids remain; and heating the slurry solids to a temperature of about 300° F. in contact with air at about 1 atmosphere pressure for about 1-2 hours to form a dry noncaking carbonaceous material.

2. The method of claim 1 wherein said alkaline earth metal hydroxide comprises an hydroxide of calcium, magnesium or barium.

3. The method of claim 2 wherein said alkaline earth metal hydroxide comprises calcium hydroxide.

* * * * *